US005983849A

United States Patent [19]

Wangen et al.

[11] Patent Number: 5,983,849

[45] Date of Patent: Nov. 16, 1999

[54] COMPOSITE PUSHROD HOLE ADAPTER PLATE FOR INTERNAL COMBUSTION ENGINES

[75] Inventors: Eric Orvis Wangen, Violoa; Floyd I. Baker, Readstown; Timothy T. Tiller, Blue River, all of Wis.

[73] Assignee: S & S Cycle, Inc., Viola, Wis.

[21] Appl. No.: 09/042,537

[22] Filed: Mar. 17, 1998

[51] Int. Cl.[6] ..... F01L 1/14

[52] U.S. Cl. ..... 123/90.61; 123/193.3; 29/888.01; 29/888.2

[58] Field of Search ..... 123/90.61, 90.37, 123/195 A, 193.3, 193.5; 29/888.01, 888.2

[56] References Cited

U.S. PATENT DOCUMENTS

| | | | |
|---|---|---|---|
| 3,038,459 | 6/1962 | Schmid | 123/90.61 |
| 3,048,156 | 8/1962 | Slooten | 123/90.61 |
| 3,195,527 | 7/1965 | Eaton | 123/90.61 |
| 3,830,209 | 8/1974 | Jones, Jr. et al. | 123/41.82 |
| 4,126,318 | 11/1978 | Belter | 277/11 |
| 4,135,478 | 1/1979 | Rassey | 123/195 C |
| 4,783,087 | 11/1988 | DeCore et al. | 277/166 |
| 5,072,697 | 12/1991 | Sputhe | 123/41.69 |
| 5,105,777 | 4/1992 | Kronich et al. | 123/193.3 |
| 5,310,198 | 5/1994 | Belter | 277/235 B |
| 5,394,843 | 3/1995 | Decuir | 123/90.61 |
| 5,421,292 | 6/1995 | Hoffman et al. | 123/41.69 |
| 5,492,085 | 2/1996 | Tiller et al. | 123/90.61 |
| 5,603,515 | 2/1997 | Bock | 277/235 B |
| 5,605,342 | 2/1997 | Genin et al. | 277/235 B |
| 5,673,661 | 10/1997 | Jesel | 123/90.61 |

FOREIGN PATENT DOCUMENTS

| | | | |
|---|---|---|---|
| 621557 | 4/1949 | United Kingdom | 123/90.61 |

*Primary Examiner*—Weilun Lo
*Attorney, Agent, or Firm*—Foley & Lardner

[57] ABSTRACT

The present invention provides an internal combustion engine component, such as a cylinder head or tappet block, which is adaptable to a variety of pushrod positions and angles. A large pushrod aperture is formed in the engine component. The aperture is large enough to accommodate one or more pushrods passing therethrough at a variety of different angles and positions. A composite pushrod hole adapter plate is attached to the engine component over the aperture. The adapter plate has one or more pushrod holes machined therethrough at desired angles and positions. A counter bore is preferably formed around each pushrod hole to provide a seat for the end of a pushrod housing. A plurality of different adapter plates, having pushrod holes and counter bores formed therein at different angles and positions, may alternatively be attached to the engine component, thereby adapting the engine component for use in combination with various different engine designs. The component may be provided along with one or more adapter plates as a kit which may be assembled onto an internal combustion engine such that a pushrod passes coaxially through each pushrod hole in the adapter plate and an end of a pushrod housing is positioned in the counter bore around the pushrod hole to form a seal between the adapter plate and the pushrod housing.

29 Claims, 8 Drawing Sheets

COMPOSITE PUSHROD HOLE ADAPTER PLATE FOR INTERNAL COMBUSTION ENGINES

FIELD OF THE INVENTION

This invention pertains generally to the field of components for internal combustion engines, and more particularly to the portions of a cylinder head or tappet block of an internal combustion engine wherein pushrods enter the cylinder head or tappet block.

BACKGROUND OF THE INVENTION

A typical internal combustion engine includes a cylinder block through which one or more engine cylinders are machined. The cylinder is typically lined with a cylinder sleeve. A piston is mounted within the cylinder sleeve for reciprocal motion therein. A cylinder head is mounted at one end of the cylinder block. A portion of the bottom surface of the cylinder head combines with the cylinder to form a combustion chamber in a portion of the cylinder between the piston and the cylinder head. A crank case is mounted at the other end of the cylinder block from the cylinder head. The end of the piston opposite the combustion chamber is coupled by a connecting rod to a crank shaft located in the crank case. As the piston is reciprocated in the cylinder by combustion in the combustion chamber, the crank shaft is turned.

The cylinder head has intake and exhaust valves mounted therein which, respectively, allow air and fuel into the combustion chamber prior to combustion and allow combustion byproducts to be exhausted from the combustion chamber following combustion. The intake and exhaust valves are actuated by cams mounted on a cam shaft which is rotated by the rotating crank shaft. The cams are designed to open the valves at precisely the correct instant of piston travel, and hold them open long enough to obtain the most efficient filling and emptying of the cylinder. In many engine designs, the cam activates a pushrod which, in turn, activates a rocker arm in the cylinder head which pushes against the end of a valve stem, thereby opening the valve. The pushrod is coupled to the cam by a cam follower tappet mounted in a tappet block connected to the crank case. The pushrod, rocker arm, and valve are the primary components of the engine valve train in such engine designs.

In many engine designs, such as motorcycle engines, the pushrod extends from a pushrod hole in the tappet block connected to the crank case, runs along the outside of the cylinder block, generally parallel with the cylinder, and enters a pushrod hole in the cylinder head, wherein the end of the pushrod is in contact with the valve rocker arm. Between the tappet block and the cylinder head the pushrod is typically enclosed within a pushrod housing. The pushrod housing is typically mounted at each end thereof in counter bores formed around the pushrod holes in the cylinder head and tappet block. The pushrod housing seals the pushrod holes in the tappet block and cylinder head through which the pushrod passes and forms a chamber through which oil and gasses flow between the crank case and cylinder head to provide oil return and venting through the cylinder head.

For any particular internal combustion engine design, such as a V-twin motorcycle engine, a multitude of crank case designs are possible. For each different crank case design, each pushrod may emerge from a pushrod hole in the tappet block at a different angle with respect to the cylinder head from the pushrod angle of the corresponding pushrod in another crank case design. Thus, the angle and position at which a pushrod enters a pushrod hole in the cylinder head will depend upon the crank case design employed. The angle and position at which the pushrod holes and counter bores for the pushrod housing are machined in the cylinder head will thus depend upon the crank case design with which a particular cylinder head is to be employed.

This creates a challenge for those who manufacture and stock engine parts. In general, a manufacturer or supplier of cylinder heads will be required to manufacture or stock a variety of similar cylinder heads, each having pushrod holes machined therein at slightly different angles. Each such cylinder head is only compatible with a limited number of crank case designs. It is difficult for the manufacturer or supplier to estimate how many of each type of cylinder head to produce or have on hand. If the manufacturer or supplier overestimates the number of cylinder heads of a particular type to be produced or stocked, in order to ensure that customer demands will be satisfied, the cost of producing or stocking the entire cylinder head may be lost, or, at best, there will be a long delay in recovering these costs. Manufacturing and warehousing or stocking a multitude of slightly different cylinder heads can thus be an expensive proposition, the cost of which will be passed on to the ultimate consumer. Failure to have a desired cylinder head on hand, however, can lead to customer dissatisfaction.

Besides increasing the cost of cylinder heads, this problem can also more directly affect consumers. For example, a motorcycle owner may decide to change out the crank case on his motorcycle engine in order to improve engine performance. Typically, the motorcycle owner may also be required to purchase a new cylinder head having pushrod holes machined therein at an angle and in a position which will accommodate the new pushrod angle of the high performance case as well.

A similar problem can occur when a differently designed cylinder head, or other valve train component, is used to replace an existing cylinder head or valve train on an internal combustion engine. Such a changeout may affect the angle and position of the pushrod with respect to the tappet block, thereby requiring replacement of the tappet block with a new tappet block having pushrod holes machined therein at the appropriate angles.

The foregoing problems could largely be avoided if a single cylinder head and/or tappet block design could be fabricated to accommodate a wide variety of pushrod angles and positions.

SUMMARY OF THE INVENTION

In accordance with the present invention, a single internal combustion engine cylinder head design is provided which may be used in combination with various crank case designs requiring various pushrod angles and positions. The new cylinder head design of the present invention makes possible a new method of assembling an internal combustion engine to better satisfy consumer demands, while minimizing costs and risks to engine part manufacturers and suppliers.

A cylinder head in accordance with the present invention is provided with at least one relatively large pushrod aperture. The pushrod aperture in the cylinder head is large enough to accommodate at least one pushrod passing therethrough at a variety of pushrod angles and positions. A recessed area or pocket is preferably formed around the pushrod aperture. Preferably, two pushrod apertures are formed in the pocket, to accommodate two pushrods passing therethrough, one each for controlling the intake and exhaust valves of a cylinder combustion chamber, at a variety of pushrod angles and positions. The pocket in the cylinder head is adapted to receive a composite pushrod hole adapter plate in accordance with the present invention. Fastener holes or other means are preferably provided in or near the pocket for fixing the adapter plate in the pocket over the pushrod aperture. An O-ring is preferably placed in a groove formed around each pushrod aperture, between the adapter plate and the cylinder head, to seal the adapter plate to the cylinder head.

A composite pushrod hole adapter plate in accordance with the present invention may preferably be formed from a thick metal or plastic plate which is cut in size and shape to fit in the adapter plate pocket and over the pushrod hole apertures formed in the cylinder head. At least one, but preferably two, pushrod holes are machined through the adapter plate. The position of a pushrod hole on the adapter plate, and the angle with which the pushrod hole is machined through the adapter plate, is selected such that, when the adapter plate is mounted on the cylinder head, an engine pushrod will pass through the pushrod hole and the pushrod aperture formed in the cylinder head into the cylinder head along the axis of the pushrod hole. A single pushrod hole adapter plate in accordance with the present invention may have multiple pushrod holes machined therethrough at different angles and positions thereon. A counter bore is preferably machined in the adapter plate around each pushrod hole, to form a mounting surface for one end of a pushrod housing. Preferably, the counter bore is machined to be coaxial with the pushrod hole. Thus, the angle of the counter bore for the pushrod housing will correspond to the angle of the pushrod hole itself. One or more fastener holes, such as bolt holes, are preferably also machined through the adapter plate, along with the pushrod holes and pushrod housing counter bores. The fastener holes are machined through the adapter plate at positions which correspond to the fastener holes formed in the adapter plate pocket in the cylinder head. The fastener holes are preferably countersunk, and are adapted to receive fasteners, such as bolts or screws, which are used to securely attach the adapter plate to the cylinder head.

In a fully assembled internal combustion engine in accordance with the present invention, a cylinder head having a composite pushrod hole adapter plate securely mounted thereon is attached to the cylinder block of an engine. A pushrod, which extends from a pushrod hole in the tappet block of the engine crank case, is passed through a pushrod hole in the adapter plate and into the cylinder head, where the end of the pushrod is placed in contact with a rocker arm in a rocker arm chamber of the cylinder head. The angle of the pushrod hole in the adapter plate corresponds to the angle at which the pushrod passes through the hole. A pushrod housing is preferably positioned around the pushrod. One end of the pushrod housing is shaped to fit into the counter bore formed in the adapter plate. The other end of the pushrod housing is shaped to fit into a similar counter bore formed around the pushrod hole in the crank case tappet block. The pushrod housing thus encloses the pushrod, sealing the pushrod holes in the adapter plate and tappet block, and providing a channel for oil and gas flow between the crank case and cylinder head to provide oil return and venting through the cylinder head.

In accordance with the present invention, different composite pushrod hole adapter plates may alternatively be mounted in the adapter plate pocket over the pushrod apertures of a single cylinder head. Each such adapter plate may have pushrod holes and pushrod housing counter bores formed at different positions on the adapter plate and/or passing at different angles through the adapter plate. By selecting the appropriate adapter plate which is to be attached to the cylinder head, a single cylinder head design may be adapted for operation on internal combustion engines having various crank case designs and pushrod angles. This allows a parts manufacturer to reduce the number of cylinder head designs which must be fabricated, while still allowing the manufacturer to provide cylinder heads for a wide variety of engines. If there is an increased demand for a cylinder head designed to accommodate specific pushrod angles, the manufacturer can more easily produce the required pushrod hole adapter plates than machine entire cylinder heads. Similarly, a parts supplier may stock a fewer number of cylinder heads, each being adapted to receive a composite pushrod hole adapter plate in accordance with the present invention. A large variety of relatively inexpensive composite pushrod hole adapter plates in accordance with the present invention may be kept on hand, allowing the supplier to satisfy the needs of a large number of customers, while minimizing unnecessary cylinder head inventory. The present invention also allows a vehicle owner, such as a motorcycle owner, to switch out a portion of the engine, such as the crank case, for example, to increase engine performance, without needing also to replace the entire cylinder head because the new case requires different pushrod angles and positions. If the cylinder head includes a composite pushrod hole adapter plate in accordance with the present invention, the motorcycle owner may be able to replace the existing adapter plate with an adapter plate having pushrod holes machined therethrough which accommodate the new pushrod angles, thereby eliminating the need to replace the cylinder head entirely.

The present invention may be provided as a kit, e.g., from the manufacturer to the parts supplier or from the supplier to an end user. The kit may include a cylinder head having a pushrod hole adapter plate pocket and pushrod apertures formed therein and a selection of different composite pushrod hole adapter plates for the cylinder head. The kit may be assembled as part of an internal combustion engine by selecting the appropriate composite pushrod hole adapter plate for the pushrod angles and positions desired or required, attaching the selected adapter plate to the cylinder head over the pushrod aperture, and mounting the cylinder head onto the cylinder block. Pushrods may then be inserted into the cylinder head through the pushrod holes in the adapter plate, and pushrod housings mounted in the counter bores formed in the adapter plate.

A composite pushrod hole adapter plate in accordance with the present invention may also be employed in combination with an internal combustion engine crank case tappet block. The tappet block may have a relatively large pushrod aperture and an adapter plate pocket formed therein. The pushrod aperture is large enough to accommodate at least one pushrod extending at various angles and positions from the tappet block. The adapter plate pocket is preferably large enough to accommodate two pushrods, one each for operating the intake and exhaust valves, passing therethrough at various angles. The adapter plate pocket is adapted to receive a composite pushrod hole adapter plate in accordance with the present invention. As described previously, the composite pushrod hole adapter plate has pushrod holes and, preferably, pushrod housing counter bores, machined therein at selected positions on the adapter plate to accommodate particular pushrod positions and angles. Thus, a single tappet block or crank case design may be adapted to accommodate a wide variety of pushrod positions and angles by selecting the appropriate composite pushrod hole adapter plate to be attached thereto.

Further objects, features, and advantages of the invention will be apparent from the following detailed description when taken in conjunction with the accompanying drawings.

DETAILED DESCRIPTION OF THE INVENTION

The present invention will now be described in detail with reference to the exemplary application of the present invention to a V-twin type internal combustion engine for a motorcycle. Of course, it should be understood that the present invention is also readily applicable to other types of internal combustion engines for motorcycles, and other internal combustion engine designs in general. Thus, the present invention is not limited to the particular exemplary applications to be described.

Figure 1:
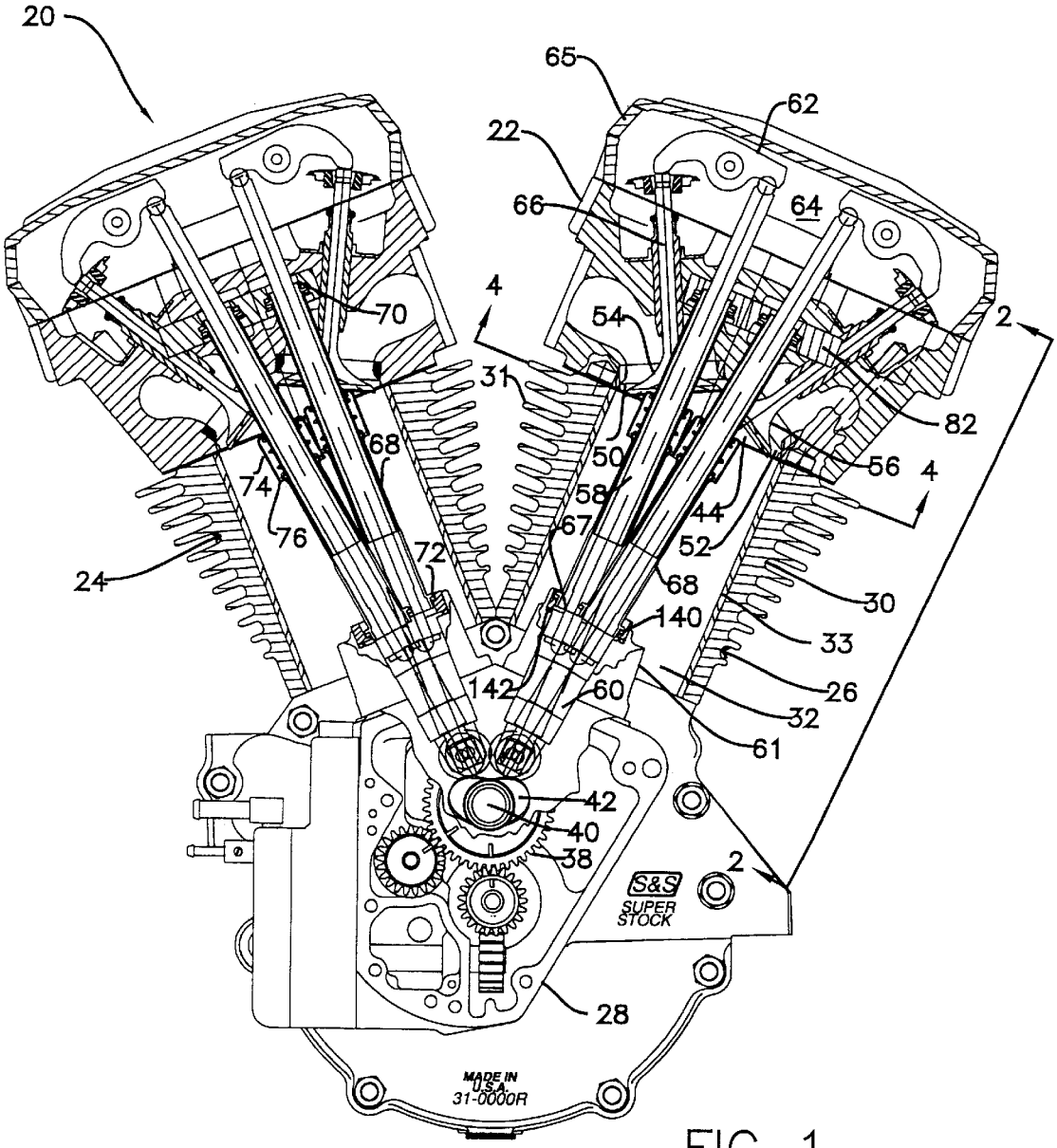
FIG. 1 is a side view, in partial cross-section, of a V-twin internal combustion motorcycle engine incorporating composite pushrod hole adapter plates in accordance with the present invention.
Figure 2:
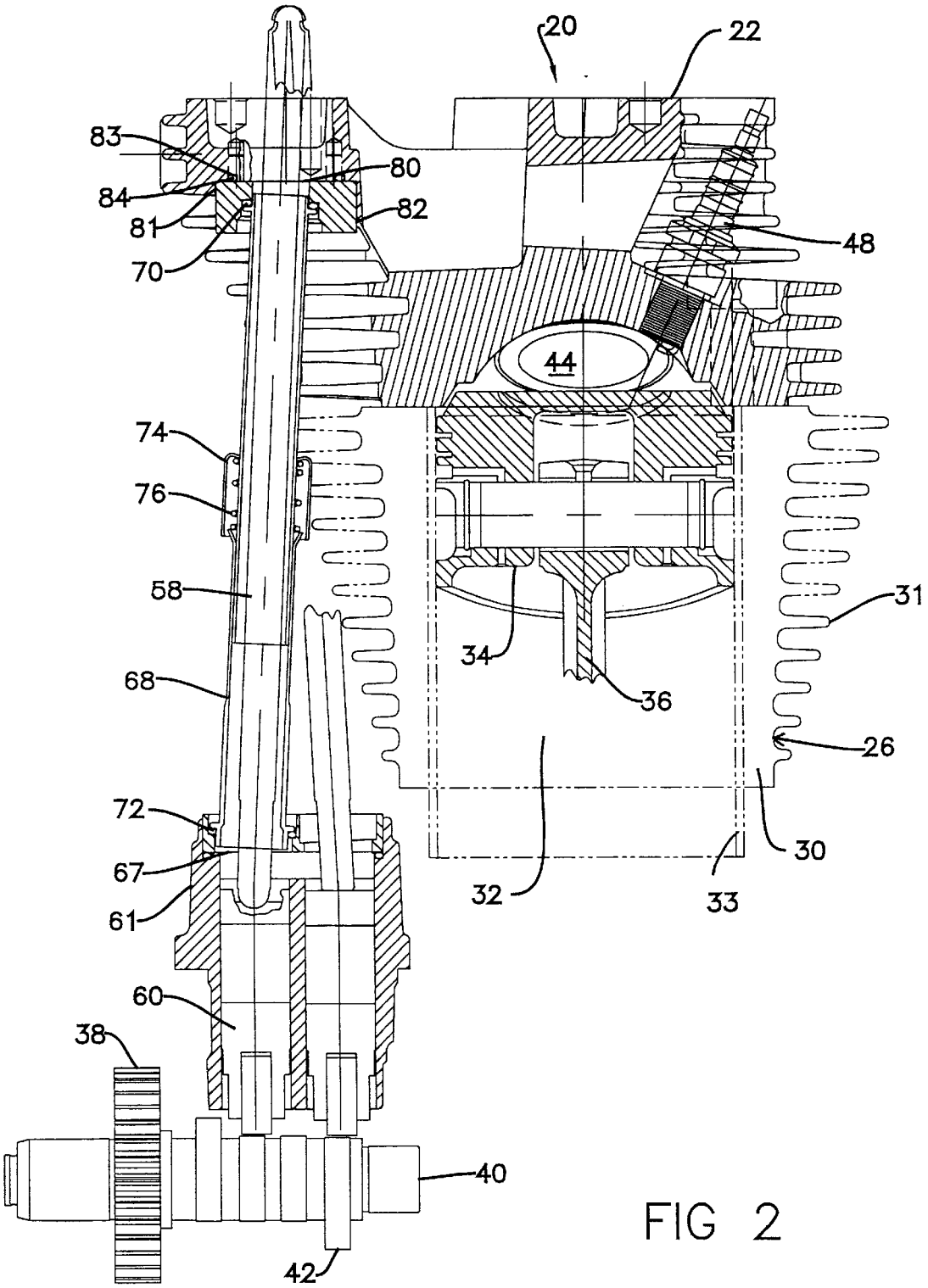
FIG. 2 is a view, in partial cross section, of a portion of the motorcycle engine illustrated in FIG. 1, as taken along the line 2—2 thereof.
Figure 3:
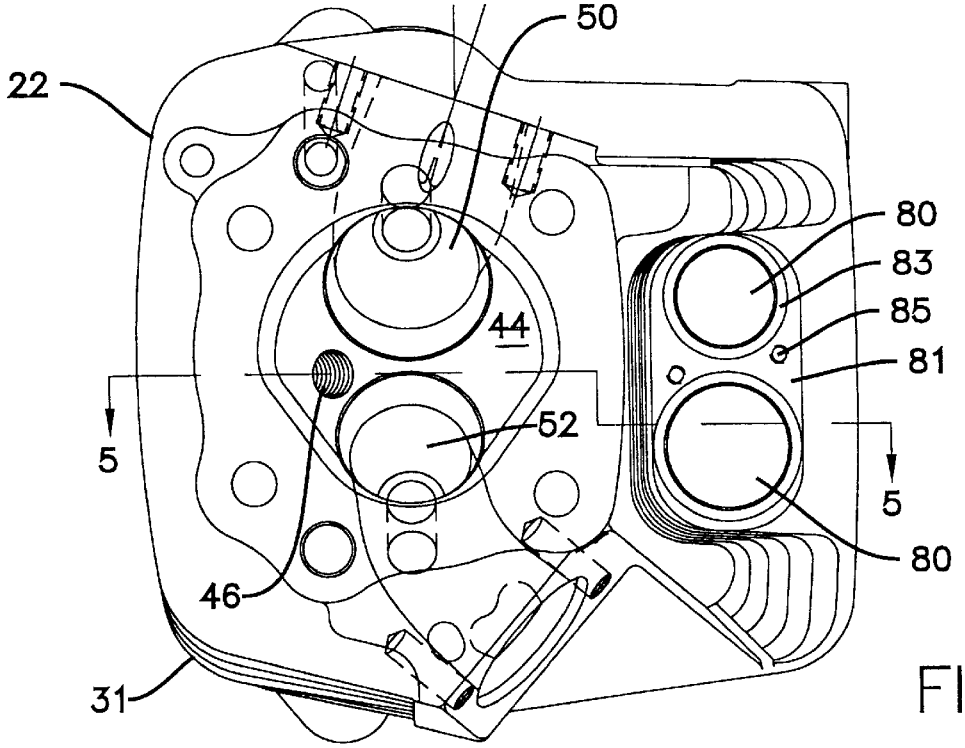
FIG. 3 is a view of the underside of a cylinder head for a V-twin internal combustion motorcycle engine having a composite pushrod hole adapter plate pocket and pushrod apertures formed therein.
Figure 4:
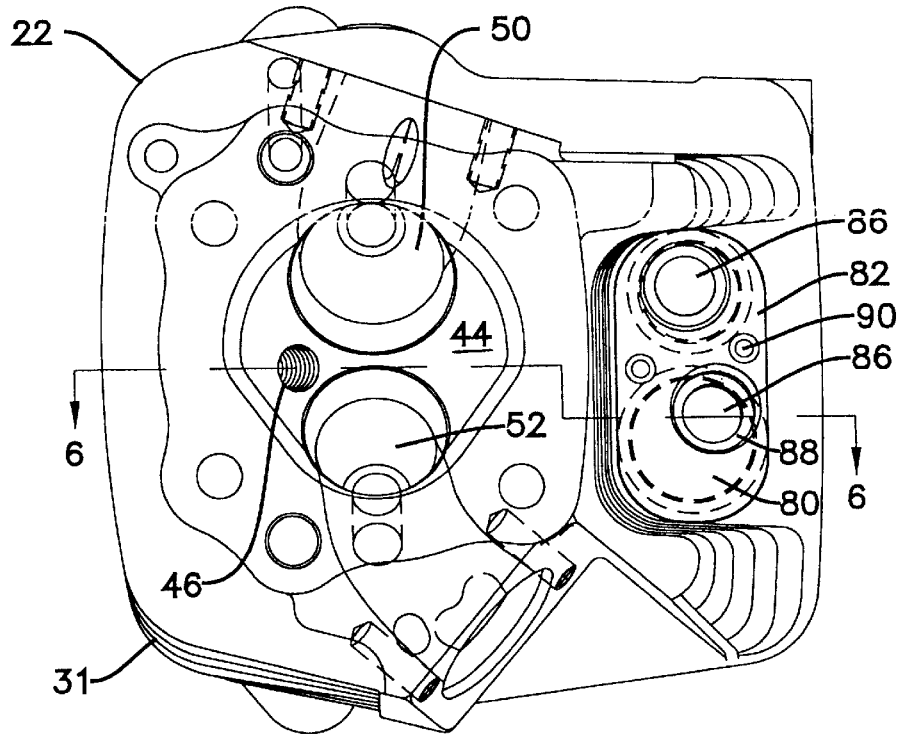
FIG. 4 is a view of the underside of the cylinder head for a V-twin internal combustion motorcycle engine of FIG. 3 (as taken along line 4—4 of FIG. 1) with a composite pushrod hole adapter plate in accordance with the present invention mounted in the composite pushrod hole adapter plate pocket thereof.
Figure 5:
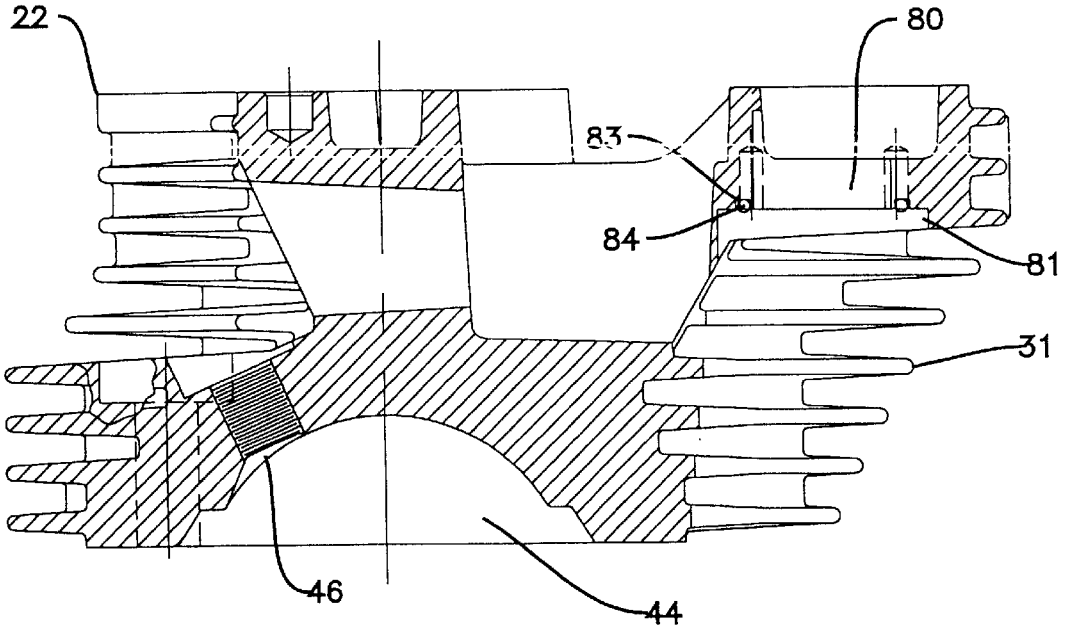
FIG. 5 is a cross-sectional view of the cylinder head of FIG. 3, as taken along the line 5—5 thereof.
Figure 6:
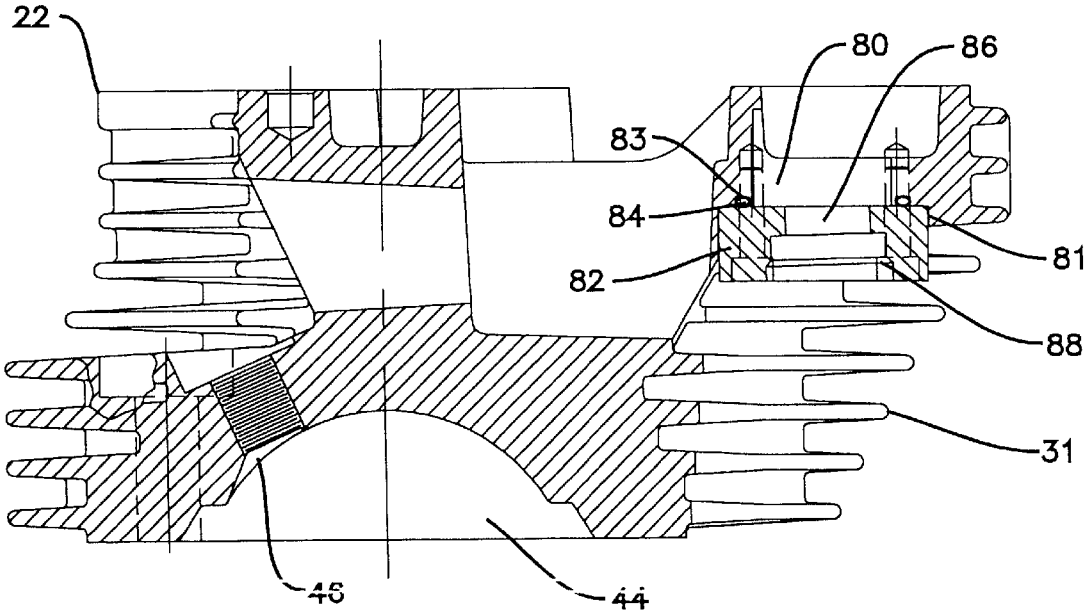
FIG. 6 is a cross-sectional view of the cylinder head of FIG. 4, as taken along the line 6—6 thereof.
Figure 7:
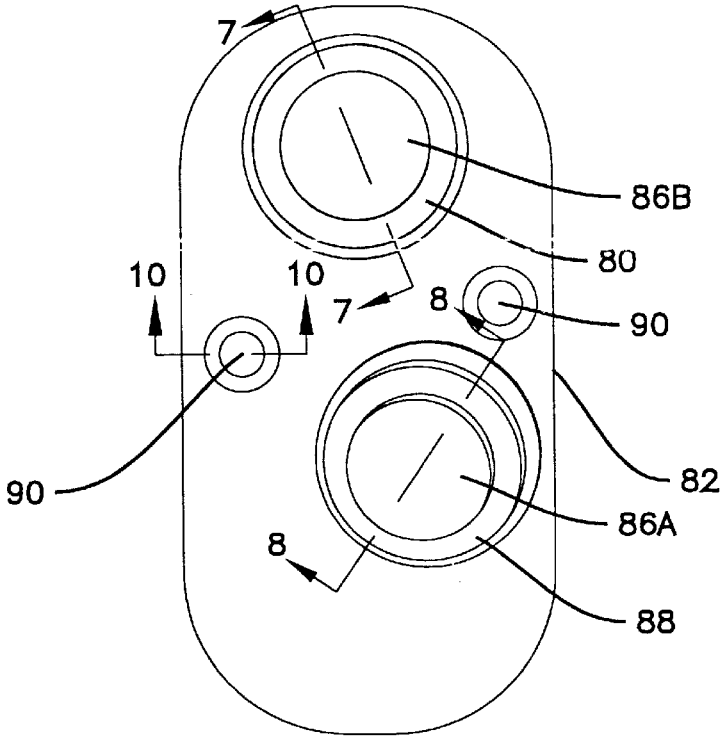
FIG. 7 is a plan view of an exemplary composite pushrod hole adapter plate in accordance with the present invention.

The present invention will be described in detail with reference to FIGS. 1–6, which should be considered together. FIG. 1 is a side view illustration, in partial cross-section, of a V-twin motorcycle engine 20. The particular engine illustrated is the Stock '84-UP Big Twin motorcycle engine made by S&S Cycle, Inc. of Viola, Wisc. FIG. 2 is an illustration, in partial cross-section, of the engine 20 as viewed from the side of FIG. 1 generally along the line of and in the direction indicated by line 2—2 of FIG. 1. FIGS. 3 and 4 are illustrations of the underside of a cylinder head 22 for the engine 20, as viewed along the line of and in the direction indicated by line 4—4 of FIG. 1. Note that FIGS. 3 and 4 illustrate the underside of a cylinder head 22 which has been detached from the rest of the engine 20. FIGS. 5 and 6 are cross sectional views of the cylinder head 22 illustrated in FIGS. 3 and 4, respectively.

The V-twin motorcycle engine 20 is a two-cylinder engine. The two cylinders 24 and 26 are each attached to, and extend from, a single crank case 28. The two cylinders 24 and 26 are substantially identical, each having identical parts and operating in the same way. Each cylinder 24 and 26 includes a cylinder block 30, mounted to the crank case 28, and a cylinder head 22 mounted to the cylinder block 30. Both the cylinder head 22 and cylinder block 30 have fins 31 integrally formed on the outside thereof for improved air cooling of the engine 20. The cylinder block 30 has a cylinder 32 formed therein. The cylinder 32 is preferably lined with a cylinder sleeve 33. A piston 34 is mounted for reciprocal motion within the cylinder sleeve 33. The piston 34 is connected by a conventional connecting rod mechanism 36 to drive a crank shaft (not shown) in the crank case 28. This shaft is connected, e.g., via gears 38 to a cam shaft 40, also mounted in the crank case 28. The cam shaft 40 has one or more cams 42 mounted thereon.

The cylinder head 22 is mounted to the end of the cylinder block 30 opposite the crank case 28. A portion of the bottom surface of the cylinder head 22 is aligned with the cylinder 32 in the cylinder block 30 to form a combustion chamber 44. Three openings are provided into the combustion chamber 44 by the cylinder head 22, a spark plug hole 46, an intake opening 50, and an exhaust opening 52. The threaded spark plug hole 46 allows a spark plug 48 to be mounted on the cylinder head. The spark electrodes of the spark plug 48 extend into the combustion chamber 44. The intake opening 50 into the combustion chamber 44 allows an air fuel mixture to be admitted into the combustion chamber 44 prior to combustion. As the piston 34 rises in the cylinder 32, the air fuel mixture in the combustion chamber 44 is compressed. The compressed air fuel mixture is ignited by a spark from the spark plug 48. The resulting combustion in the combustion chamber 44 forcefully drives the piston 34 downward in the cylinder 32. The movement of the piston 34 causes rotation of the cam shaft 40. Following combustion, the piston 34 is once again driven upward in the cylinder 32, forcing the remaining gasses out of the combustion chamber 44 through the exhaust opening 52 in the cylinder head 22.

Opening and closing of the intake 50 and exhaust 52 openings in the cylinder head is controlled by intake 54 and exhaust 56 valves, respectively. The intake 54 and exhaust 56 valves are actuated by the cams 42, which are designed to open the valves 54 and 56 at precisely the correct instant of piston travel, and hold them open long enough to attain the most efficient filling and emptying of the cylinder 32.

In many conventional internal combustion engine designs, including the exemplary engine design being described, the intake 54 and exhaust 56 valves are mechanically coupled to the cams 42 on the cam shaft 40 by pushrods 58. A pushrod 58 is activated by a cam follower, tappet 60 or lifter which is mounted in a tappet block 61 attached to the crank case 28 and which is driven by the cam 42. At the opposite end of the pushrod 58 from the cam follower tappet 60, the pushrod 58 is in contact with one end of a rocker arm 62 mounted in a rocker arm chamber 64. The rocker arm chamber 64 is enclosed by a rocker box 65 which is attached to the cylinder head 22. The other end of the rocker arm 62 is positioned to transmit force to the top surface of a valve stem 66 which, in turn, opens the intake 54 or exhaust 56 valve when the pushrod 58 is lifted by rotation of the cam 42.

As illustrated, the pushrod 58 extends from an aperture 67 in the tappet block 61 and passes through a similar aperture into the cylinder head 22, wherein it is in contact with the rocker arm 62. Between the cylinder head 22 and the tappet block 61, the pushrod 58 extends along the outside of the cylinder block 30, generally parallel with the cylinder 32. A pushrod housing 68 preferably encloses the pushrod 58 between the cylinder head 22 and the tappet block 61. The pushrod housing 68 is typically formed of a hollow cylindrical tube of metal (e.g., aluminum, stainless steel, chrome plated steel, etc.) which sits between the pushrod opening to the rocker arm chamber 64 in the cylinder head 22 and the pushrod opening into the tappet block 61. The upper end of the pushrod housing 68 is shaped to fit the opening in the cylinder head 22 to the rocker arm chamber 64. An O-ring 70, or other type of gasket, may be used to seal the interface between the pushrod housing 68 and the cylinder head 22. The lower end of the pushrod housing 68 is shaped to fit into a counter bore in the tappet block 61, which forms a shoulder against which the lower end of the housing 68 is engaged. This interface junction may also be sealed by an O-ring 72, or other type of gasket. The pushrod housing 68 may be formed of two pieces joined together at an adjustment collar 74 containing a compression spring 76. The compression spring 76 forces the lower end of the pushrod housing 68 against the counter bore formed in the tappet block 61 and the upper end of the pushrod housing 68 against a similar structure formed in the cylinder head 22 to assure a good seal between the housing 68 and the cylinder head 22 and tappet block 61. During operation of the engine 20, oil and gasses flow within the pushrod housing 68 between the cylinder head 22 and the crank case 28 to thereby drain the cylinder head 22 of oil and gasses.

The angle and position at which a pushrod 58 enters the cylinder head 22, given a particular rocker arm 62 arrangement, depends on the design of the other engine components, particularly the crank case 28. In order for a single cylinder head design to be used on engines having different crank case designs, and, therefore, different pushrod angles, a relatively large pushrod aperture 80 is provided in the bottom surface of the cylinder head 22. This aperture 80 is large enough to accommodate at least one pushrod 58 passing therethrough into the cylinder head 22 at various different angles and positions. A recessed area or pocket 81 is preferably formed around the pushrod aperture 80. Preferably, two pushrod apertures 80 are formed within the pocket 81 to accommodate both pushrods 58 used for operating the intake and exhaust valves of a cylinder passing therethrough into the cylinder head 22 and entering the rocker arm chamber 64 at various different angles and positions. In accordance with the present invention, the pocket 81 in the bottom of the cylinder head 22 is adapted to receive a composite pushrod hole adapter plate 82. Grooves 83 are preferably formed around each pushrod hole aperture 80 in the adapter plate pocket 81. An O-ring 84 is preferably positioned in each groove 83. When the composite pushrod hole adapter plate 82 is positioned in the pocket 81, the O-rings 84 are compressed between the adapter plate and the cylinder head 22 to create a seal between the adapter plate 82 and the cylinder head 22 around each pushrod aperture 80. Fastener holes 85 or other structures whereby the adapter plate 82 may be fixed securely in position in the pocket 81 are preferably formed in the cylinder head 22 within the pocket 81. Although the adapter plate pocket 81 facilitates proper positioning and secure attaching of the adapter plate 82 over the pushrod aperture 80, the use of an adapter plate pocket 81 is preferred but not required. Any conventional mechanism may be used to attach the adapter plate 82 securely to the cylinder head 22 over the pushrod aperture 80.

FIGS. 4 and 6 show a composite pushrod hole adapter plate 82 in accordance with the present invention positioned in the adapter plate pocket 81 formed in a cylinder head 22 and over pushrod apertures 80 machined in the cylinder head 22. In accordance with the present invention, a composite pushrod hole adapter plate 82 includes a pushrod hole 86 machined therethrough at an appropriate angle and in an appropriate position for each pushrod 58 which extends from the tappet block 61 through a pushrod aperture 80 into the rocker arm chamber 64 in the cylinder head 22. Each pushrod hole 86 formed in the adapter plate 82 is positioned thereon to be aligned with a pushrod aperture 80 formed in the cylinder head 22 when the adapter plate 82 is positioned in the adapter plate pocket 81 in the cylinder head 22. A counter bore 88 is preferably machined around each pushrod hole 86 in the adapter plate 82. The counter bore 88 provides a seat for the end of a pushrod housing 68.

An exemplary composite pushrod hole adapter plate 82 in accordance with the present invention is illustrated in and will be described in more detail with reference to FIGS. 7–10. The adapter plate 82 may be of any shape, and is sized to fit in the adapter plate pocket 81 and cover the pushrod aperture 80 in the cylinder head 22. As illustrated, the composite pushrod hole adapter plate 82 preferably includes two pushrod holes 86A and 86B machined therethrough. One of the pushrod holes provides access to the rocker arm chamber 64 by a pushrod 58 which actuates the intake valve, the other pushrod hole provides access to the rocker arm chamber 64 by a second pushrod 58 which actuates the exhaust valve. An adapter plate 82 having a single pushrod hole machined therethrough may also be used in accordance with the present invention. However, if such an adapter plate is used, separate adapter plates would be needed for each pushrod extending from the crank case 28 into the cylinder head 22. Thus, for example, two separate composite pushrod hole adapter plates in accordance with the present invention could be employed on a single cylinder head of a V-twin type motorcycle engine. In many internal combustion engine designs, more than two pushrods will extend from the crank case 28 to a single cylinder head. In such a case, a single larger pushrod aperture and adapter plate pocket, or multiple such apertures and pockets, may be formed in the cylinder head, and a large adapter plate having more than two pushrod holes machined therethrough or many adapter plates having only one or two pushrod holes machined therethrough in accordance with the present invention may be employed.

The positions of the pushrod holes 86 on the adapter plate 82, and the angles with which the pushrod holes 86 are machined through the adapter plate 82, will depend on the positions and angles of the pushrods 58. As discussed previously, the pushrod positions and angles are defined by the engine design, and, particularly, the crank case design.

Figure 9:
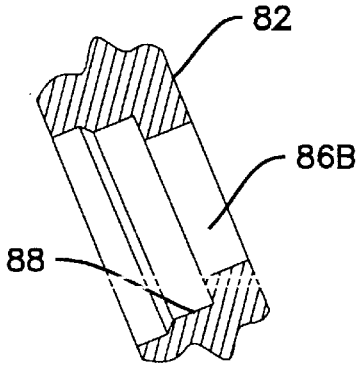
FIG. 9 is a cross-sectional view of the composite pushrod hole adapter plate of FIG. 7 as taken along the line 9—9 thereof.
Figure 8:
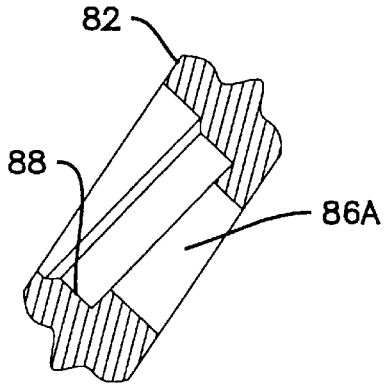
FIG. 8 is a cross-sectional view of the composite pushrod hole adapter plate of FIG. 7 as taken along the line 8—8 thereof.

The cross-sectional views of FIGS. 8 and 9 illustrate that each pushrod hole 86 machined through the adapter plate 82 may be machined through the adapter plate 82 at a different angle. Of course, both pushrod holes 86 may be machined through the adapter plate 82 at the same angle, depending upon the engine design.

As also illustrated in FIGS. 8 and 9, the adapter plate 82 is preferably fabricated from a thick piece of material, such as metal or plastic, although metal is preferred. For example, an adapter plate 82 for use in a V-twin motorcycle engine may be approximately 0.625 inches thick. A thick adapter plate 82 allows a counter bore 88 to be machined into the adapter plate 82 around each pushrod hole 86 machined through the adapter plate 82. The counter bore 88 provides a shoulder or seat for the end of a pushrod housing 68 which rests in the counter bore 88. The counter bore 88 may preferably be shaped to cooperate with the shape of the end of the pushrod housing 68, and any O-ring 70 or other gasket mounted thereon, to provide a good seal between the pushrod housing 68 and the adapter plate 82, and, therefore, between the interior of the pushrod housing 68 and the rocker arm chamber 64 in the cylinder head 22. The counter bore 88 is preferably machined in the adapter plate 82 to be coaxial with its corresponding pushrod hole 86. The desirability for a thick adapter plate 82 is illustrated, by example, in FIG. 8, wherein a pushrod hole 86A, and the corresponding counter bore 88, are formed at a relatively large angle with respect to the adapter plate surface. A thick piece of material is required in order to form a sufficiently deep counter bore all the way around the pushrod hole 86A.

Figure 10:
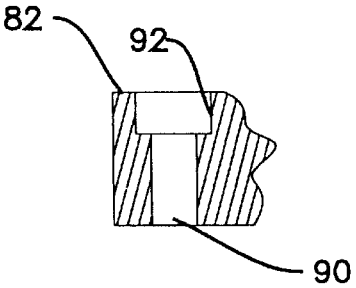
FIG. 10 is a cross-sectional view of the composite pushrod hole adapter plate of FIG. 7 as taken along the line 10—10 thereof.

Along with the pushrod holes 86, and corresponding counter bores 88, one or more fastener holes 90 are also preferably machined through the adapter plate 82. As illustrated in FIG. 10, the fastener holes 90 are preferably bored to form a counter sink 92. The fastener holes 90 are positioned on the adapter plate 82 such that when the adapter plate is positioned on the cylinder head 22 the fastener holes 90 in the adapter plate 82 are aligned with the corresponding fastener holes 85 on the cylinder head 22. A fastener, such as a bolt, screw, or other fastener, may then be passed through the fastener hole 90 in the adapter plate 82 and into the corresponding fastener hole 85 in the cylinder head 22 to securely attach the adapter plate 82 to the cylinder head 22. Thus, the adapter plate 82 is preferably removably attached to the cylinder head 22. Alternatively, the adapter plate 82 may be permanently mounted to the cylinder head 22, such as by welding.

In accordance with the present invention, a single cylinder head design 22 may be adapted for use on engines having a variety of crank case designs, and, therefore, a variety of pushrod positions and angles. Cylinder head adaptability is achieved by simply selecting an appropriate adapter plate having pushrod holes machined therethrough at positions and angles which will accommodate the positions and angles of the pushrods in the desired engine design.

Figure 11:
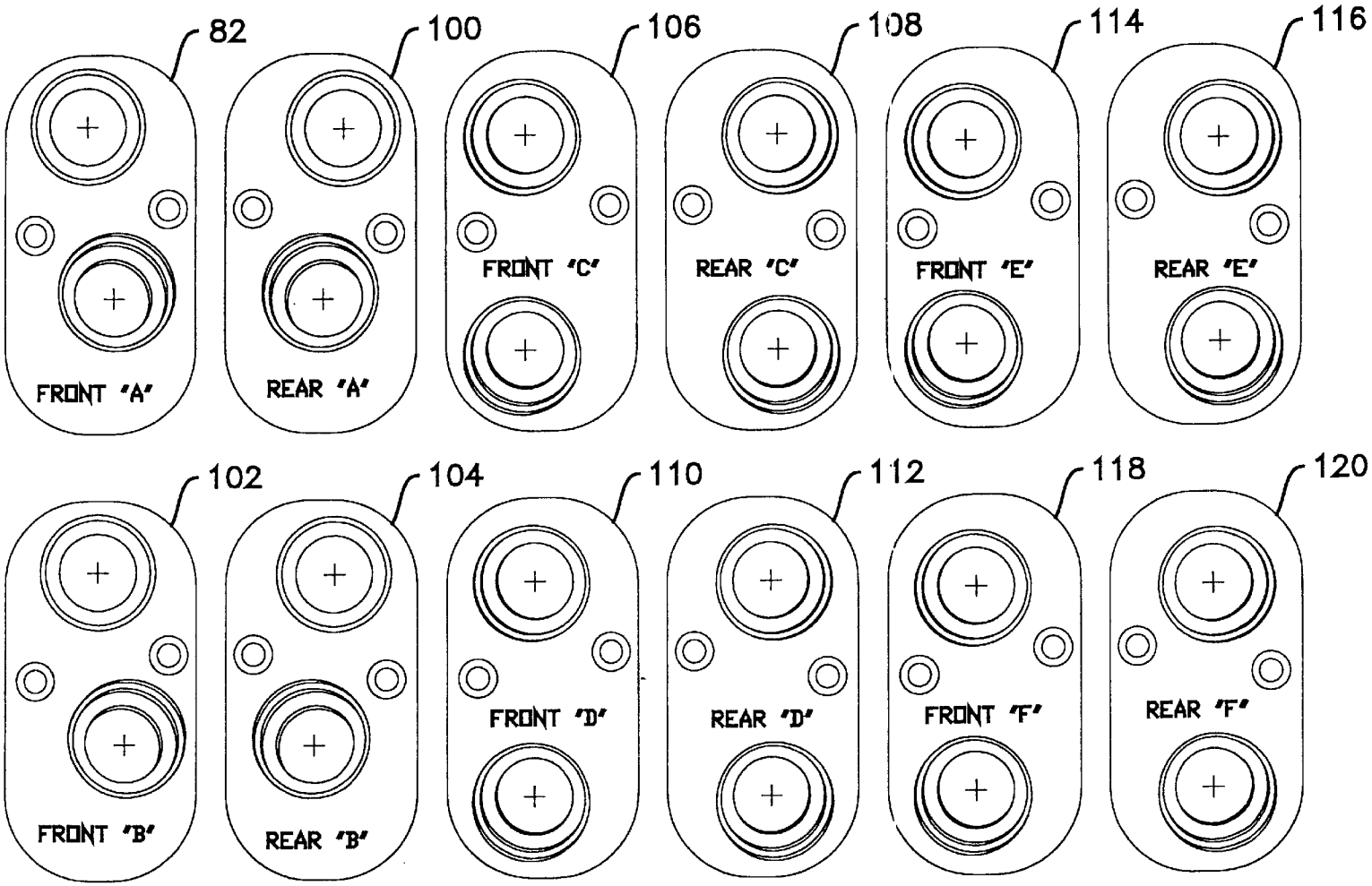
FIG. 11 is a plan view illustrating, by example, a variety of composite pushrod hole adapter plates having various pushrod hole placements on the adapter plate and angles therethrough which may be provided for a single cylinder head in accordance with the present invention.

FIG. 11 illustrates, by example, various different adapter plates which may be used in combination with the cylinder head 22 illustrated in FIG. 1. These adapter plates may be used to adapt the cylinder head 22 for use in combination with a wide variety of V-twin motorcycle engine designs. For each V-twin motorcycle engine, a front and rear adapter plate is required, one for each of the V-twin engine cylinders.

Exemplary adapter plate 82, which has been described in detail herein, is used to adapt the cylinder head 22 for use on the front cylinder 26 of a Stock '84-UP Big Twin motorcycle engine, as illustrated in FIG. 1. Adapter plate 100 is the corresponding adapter plate which may be used to adapt the cylinder head 22 for use on the rear cylinder 24 of the same engine. Exemplary adapter plate 102 may be used to adapt the cylinder head 22 illustrated in FIG. 1 for use on the front cylinder of an S&S SA '84-UP Big Twin motorcycle engine. Exemplary adapter plate 104 is the corresponding adapter plate which may be used to adapt the cylinder head 22 for use on the rear cylinder of this engine. Exemplary adapter plate 106 may be used to adapt the cylinder head 22 of FIG. 1 for use on a stock '86 to '90 XL V-twin motorcycle engine. Exemplary adapter plate 108 is the corresponding adapter plate which would be used on the cylinder head for the rear cylinder of this engine. Exemplary adapter plate 110 may be used to adapt the cylinder head 22 illustrated in FIG. 1 for use on the front cylinder of an S&S '86 to '90 XL V-twin motorcycle engine. Exemplary adapter plate 112 is the corresponding adapter plate which would be used on the cylinder head for the rear cylinder of this engine. Exemplary adapter plate 114 may be used to adapt the cylinder head 22 of FIG. 1 for use on the front cylinder of a Stock '91-UP XL V-twin motorcycle engine. Exemplary adapter plate 116 is the corresponding adapter plate for use on a cylinder head for the rear cylinder of this engine. Exemplary adapter plate 118 may be used to adapt the cylinder head 22 illustrated in FIG. 1 for use on the front cylinder of an S&S '91-UP XL V-twin motorcycle engine. Exemplary adapter plate 120 is the corresponding adapter plate which would be used on the cylinder head for the rear cylinder of this engine. (Note that all of the exemplary V-twin engines described in this paragraph are available from S&S Cycle, Inc. of Viola, Wisc.)

Figure 12:
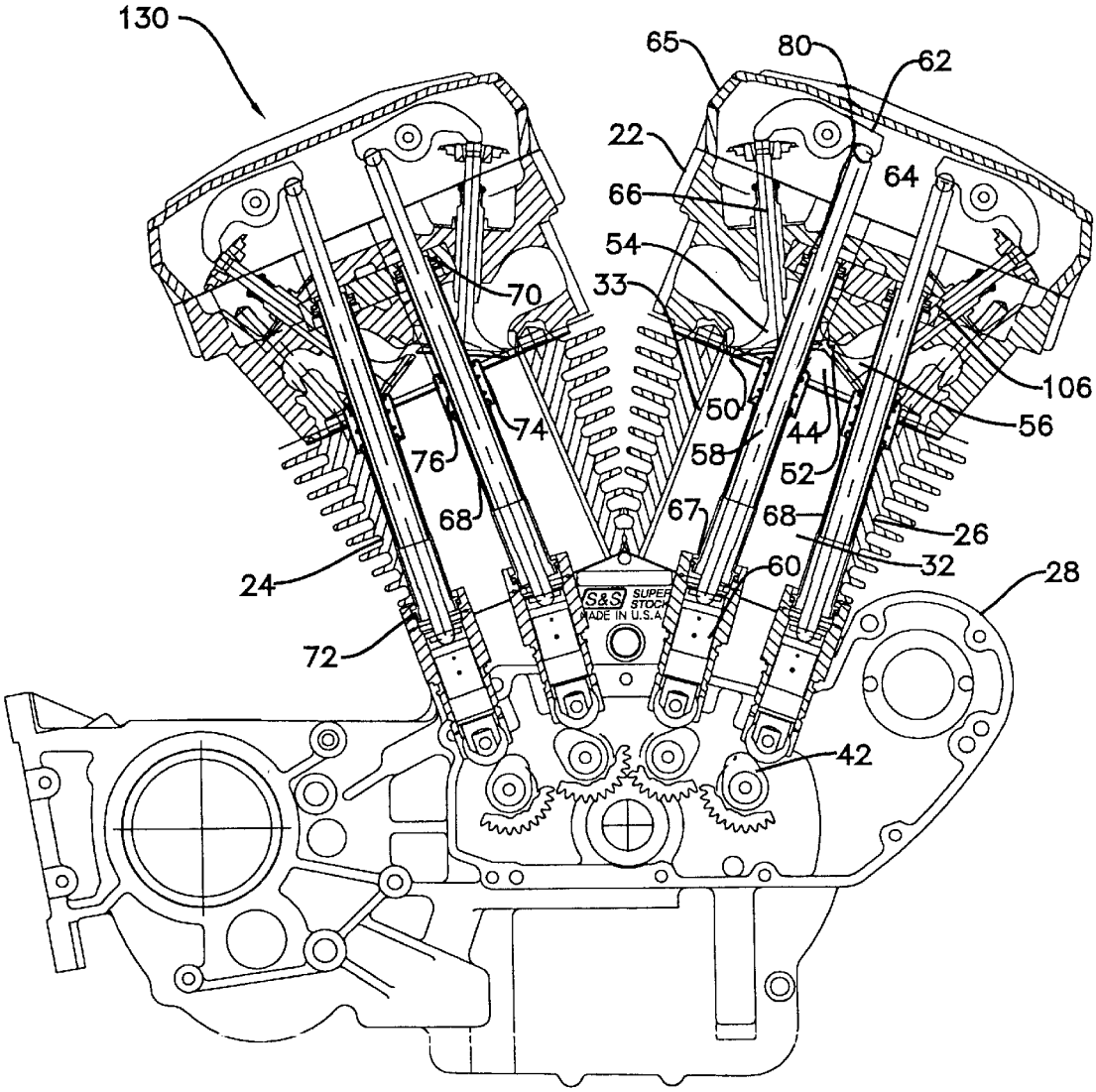
FIG. 12 is a cross-sectional view of a V-twin motorcycle engine design having different pushrod angles and positions than the engine illustrated in FIG. 1, and employing different composite pushrod hole adapter plates but the same cylinder heads as the engine of FIG. 1.

FIG. 12 is an illustration, in partial cross-section, of a Stock '86 to '90 XL V-twin motorcycle engine, available from S&S Cycle, Inc. This engine 130 includes essentially the same components as, and operates in essentially the same manner as, the engine 20 previously described with reference to FIG. 1. Thus, components of the engine 130 are labeled with the same reference numerals as were used for corresponding components of the engine 20 illustrated in FIG. 1. In comparing the engines 20 and 130 in FIGS. 1 and 12, it is immediately apparent that the angles and positions of the pushrods 58 extending from the crank case 28 in the engine 130 of FIG. 12 are different from the angles and positions of the pushrods 58 extending from the crank case 28 in the engine 20 of FIG. 1. Nevertheless, the exact same cylinder head 22 may be used for the front 26 and rear 24 cylinders of the engine 130 of FIG. 12 as are used on the front 26 and rear 24 cylinders of the engine 20 of FIG. 1. This is because a cylinder head 22 having pushrod hole apertures 80 formed therein in accordance with the present invention is employed. To adapt the cylinder head 22 employed in the engine 20 illustrated in FIG. 1 for use in the engine 130 illustrated in FIG. 12, the adapter plate 82 used in FIG. 1 is replaced with the adapter plate 106, which is appropriate for the pushrod angles and positions required by the (front cylinder of) engine 130. The comparison of FIGS. 1 and 12 thus illustrates one significant advantage of the present invention. A single cylinder head design 22 may be used in combination with a variety of engines (e.g., 20 and 130) having different pushrod angles and positions.

It is apparent that the present invention provides a new and improved cylinder head design which may be used in combination with various internal combustion engine designs requiring various pushrod angles and positions. The new cylinder head design of the present invention also makes possible a new method of assembling an internal combustion engine.

A cylinder head and one or more composite pushrod hole adapter plates in accordance with the present invention may be provided as a kit. Each kit may contain, for example, a cylinder head 22, having a pushrod aperture 80 formed therein, and one or more composite pushrod hole adapter plates to be attached to the cylinder head 22 over the aperture 80. O-rings 84, to be positioned in grooves 83 formed in the cylinder head 22 around each pushrod aperture 80, may be included in the kit. Other engine components, such as pushrods 58, pushrod covers 68, and other valve train components, may also be included in the kit.

The composite pushrod hole adapter plate kit components may be assembled onto an internal combustion engine. A composite pushrod hole adapter plate having a pushrod hole formed therein at the desired angle and position is selected. The selected composite pushrod hole adapter plate is secured to the cylinder head 22 over the pushrod aperture 80, e.g., in the adapter plate pocket 81. An O-ring 84 positioned in a groove 83 formed around the pushrod aperture 80 is compressed when the adapter plate 82 is secured to the cylinder head 22 to assure a good seal between the adapter plate 82 and the cylinder head 22. The cylinder head 22 is then secured to the end of the cylinder block 30. A pushrod, which extends from the crank case of the engine, is positioned in the pushrod hole in the adapter plate such that the pushrod is centered along the axis of the pushrod hole. A pushrod housing 68 may be positioned around the pushrod 58 by mounting an end of the housing 68 in the counter bore 88 machined around the pushrod hole 86 in the adapter plate 82. When placed in the counter bore 88, the end of the pushrod housing 68 forms a seal between the adapter plate and the housing 68.

The present invention provides for the possibility of employing a single cylinder head design which may be adapted for use on internal combustion engines having various crank case designs and pushrod angles. This allows a parts manufacturer to reduce the number of cylinder head designs which must be fabricated, while still allowing the manufacturer to provide cylinder heads for a wide variety of engines. If there is an increased demand for a cylinder head designed to accommodate specific pushrod angles, the manufacturer can more easily produce the required pushrod hole adapter plates than entire cylinder heads. Similarly, a parts supplier may stock a fewer number of cylinder heads, each being adapted to receive a composite pushrod hole adapter plate in accordance with the present invention. A large variety of relatively inexpensive composite pushrod hole adapter plates in accordance with the present invention may be kept on hand, allowing the supplier to satisfy the needs of a large number of customers, while minimizing unnecessary cylinder head inventory. The present invention also allows a vehicle owner, such as a motorcycle owner, to switch out a portion of an engine, such as the crank case, for example, to increase engine performance, without needing to replace the entire cylinder head because new pushrod angles and positions are required by the new case. If the cylinder head includes a composite pushrod hole adapter plate in accordance with the present invention, the motorcycle owner may be able to replace the existing adapter plate with an adapter plate having pushrod holes machined therethrough which accommodate the new pushrod angles, thereby eliminating the need to replace the cylinder head entirely.

A composite pushrod hole adapter plate in accordance with the present invention may be employed in combination with any component of an internal combustion engine having pushrod holes through which pushrods must pass. For example, in the internal combustion engine 20 described previously with respect to FIG. 1, each pushrod 58 must pass through a pushrod hole in the tappet block 61, as well as a pushrod hole into the cylinder head 22. For different engine designs, the angle and position at which a pushrod 58 passes through the pushrod hole in the tappet block 61 may vary. The same tappet block 61 design may be employed for these various engine configurations if a composite pushrod hole adapter plate in accordance with the present invention is employed.

In order to employ a composite pushrod hole adapter plate in accordance with the present invention in combination with a tappet block 61, one or more large pushrod apertures must be formed in the tappet block 61. Each pushrod aperture in the tappet block 61 is large enough to accommodate one or more pushrods passing therethrough at various pushrod angles and positions. The tappet block 61 is also adapted to receive a composite pushrod hole adapter plate 140 in accordance with the present invention over the pushrod aperture. For example, a pocket may be formed in the tappet block 61 around the pushrod aperture to receive the adapter plate 140. An O-ring 142 may be placed in between the adapter plate 140 and the tappet block 61, e.g., in a groove formed around the pushrod aperture in the tappet block 61. The O-ring 142 is compressed when the adapter plate 140 is mounted on the tappet block 61 to form a good seal between the adapter plate 140 and the tappet block 61. The adapter plate may be mounted over the pushrod aperture in the tappet block either removably, in a manner described previously herein, or permanently. The composite pushrod hole adapter plate 140 includes one or more pushrod holes machined therethrough at angles and in positions as required by the particular engine design with which the adapter plate 140 is being employed. The adapter plate 140 preferably also includes counter bores formed around each pushrod hole machined therethrough. The counter bore provides a mounting shoulder or seat for the lower end of a pushrod housing 68, and an O-ring 72 for sealing the lower end of the pushrod housing 68 to the adapter plate 140, and, therefore, to the tappet block 61.

Figure 13:
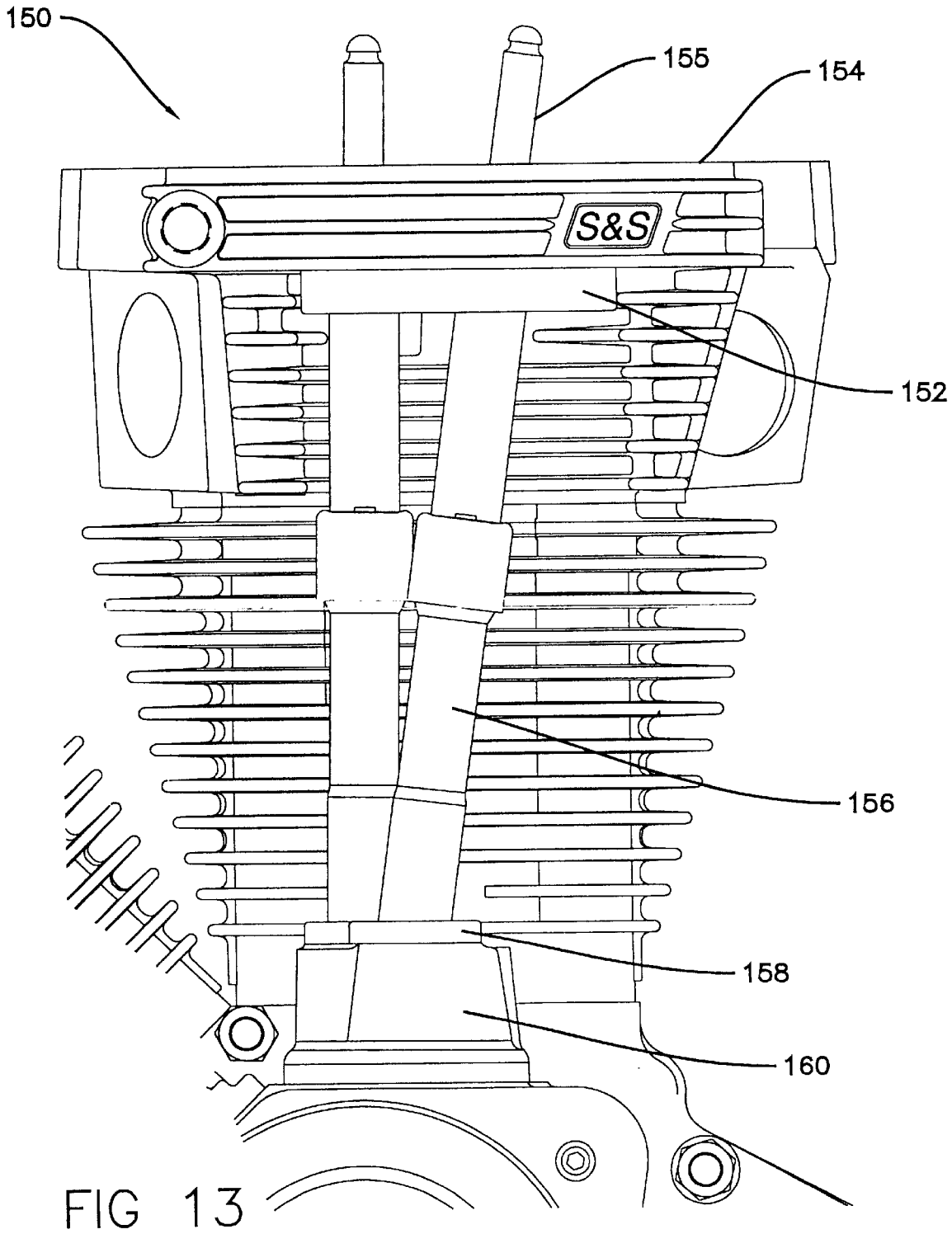
FIG. 13 is a side view of a portion of a V-twin motorcycle engine illustrating the use of composite pushrod hole adapter plates in accordance with the present invention on both the cylinder head and tappet block of the engine.

A composite pushrod hole adapter plate in accordance with the present invention may thus be used on either the cylinder head or tappet block of an internal combustion engine, or both. For example, FIG. 13 illustrates a portion of an exemplary motorcycle engine 150, wherein a composite pushrod hole adapter plate 152 in accordance with the present invention is employed at the cylinder head 154 end of a pushrod 155, enclosed in pushrod housing 156, and a second composite pushrod hole adapter plate 158 is employed at the tappet block 160 end of the pushrod 155. Note that one end of the pushrod housing 156 is attached to the composite pushrod hole adapter plate 152 at the cylinder head end 154 of the pushrod 155, and the other end of the pushrod housing 156 is attached to the composite pushrod hole adapter plate 158 located at the tappet block 160 end of the pushrod 155. Based on the detailed description provided herein of a composite pushrod hole adapter plate for use on the cylinder head of an internal combustion engine, a person skilled in the art will be able to design and fabricate pushrod hole adapter plates for use in combination with tappet blocks or any other engine component which it may be desirable to make adaptable to a variety of pushrod positions and angles.

Although described herein with respect to a particular type of motorcycle engine design, it is important to reemphasize that the present invention is not limited to application in V-twin motorcycle engines of the type described, by example, herein. The present invention may be employed in combination with a variety of different motorcycle engine designs and engine component designs, and with engines made by several different manufacturers. The present invention may also be employed in combination with internal combustion engine designs for use in vehicles other than motorcycles and for other applications.

Thus, it should be understood that the invention is not confined to the particular exemplary applications described herein, nor the particular construction and arrangement of parts herein illustrated and described, but embraces such modified forms thereof as come within the scope of the following claims.

What is claimed is:

1. A composite pushrod hole adapter plate for an internal combustion engine, comprising:

(a) an adapter plate having first and second parallel faces and sized and shaped to cover a pushrod aperture formed in a component of an internal combustion engine;

(b) at least one purshrod hole extending entirely through the adapter plate from the first face to the second face at a non-perpendicular angle to both the first face and the second face; and (c) a counter bore formed around the pushrod hole wherein the counter bore is formed coaxial with and at an angle corresponding to the angle of the pushrod hole.

2. The composite pushrod hole adapter plate of claim 1 comprising additionally at least one fastener hole extending entirely through the adapter plate.

3. The composite pushrod hole adapter plate of claim 2 comprising additionally a counter bore formed around each of the fastener holes.

4. A composite pushrod hole adapter plate for an internal combustion engine, comprising:

(a) an adapter plate sized and shaped to cover a pushrod aperture formed in a component of an internal combustion engine;

(b) at least two pushrod holes extending entirely through the adapter plate and wherein a first pushrod hole extends through the adapter plate at a first angle which is different from a second angle at which a second pushrod hole extends through the adapter plate; and (c) a counter bore formed around each of the pushrod holes wherein each counter bore is formed coaxial with and at an angle corresponding to the angle of its corresponding pushrod hole.

5. The composite pushrod hole adapter plate of claim 4 comprising additionally at least one fastener hole extending entirely through the adapter plate.

6. The composite pushrod hole adapter plate of claim 5 comprising additionally a counter bore formed around each of the faster holes.

7. An internal combustion engine having a component adaptable to a variety of pushrod positions and angles, comprising:

(a) a tappet block having a pushrod hole aperture formed therein, wherein the pushrod hole aperture is sufficiently large to allow a pushrod to pass therethrough at a plurality of pushrod positions and angles;

(b) a composite pushrod hole adapter plate mounted over the pushrod hole aperture, the composite pushrod hole adapter plate having at least one pushrod hole extending therethrough at an angle and having a counter bore formed coaxial with the pushrod hole at an angle corresponding to the angle of the pushrod hole;

(c) a pushrod extending through the pushrod hole at an angle corresponding to the angle of the pushrod hole; and (d) a pushrod housing mounted around the pushrod and having an end mounted in the counter bore in the composite pushrod hole adapter plate.

8. An internal combustion engine having a component adaptable to a variety of pushrod positions and angles, comprising:

(a) an engine component having a pushrod hole aperture formed therein, wherein the pushrod hole aperture is sufficiently large to allow a pushrod to pass therethrough at a plurality of pushrod positions and angles, and a pushrod hole adapter plate pocket formed therein around the pushrod hole aperture and shaped to receive a composite pushrod hole adapter plate;

(b) a composite pushrod hole adapter plate mounted over the pushrod hole aperture, the composite pushrod hole adapter plate having at least one pushrod hole extending therethrough at an angle and having a counter bore formed coaxial with the pushrod hole at an angle corresponding to the angle of the pushrod hole;

(c) a pushrod extending through the pushrod hole at an angle corresponding to the angle of the pushrod hole; and (d) a pushrod housing mounted around the pushrod and having an end mounted in the counter bore in the composite pushrod hole adapter plate.

9. An internal combustion engine having a component adaptable to a variety of pushrod positions and angles, comprising:

(a) an engine component having a pushrod hole aperture formed therein, wherein the pushrod hole aperture is sufficiently large to allow a pushrod to pass therethrough at a plurality of pushrod positions and angles, and including a groove formed around the pushrod hole aperture and an O-ring positioned in the groove to form a seal between the engine component and a composite pushrod hole adapter plate;

(b) a composite pushrod hole adapter plate mounted over the pushrod hole aperture, the composite pushrod hole adapter plate having at least one pushrod hole extending therethrough at an angle and having a counter bore formed coaxial with the pushrod hole at an angle corresponding to the angle of the pushrod hole;

(c) a pushrod extending through the pushrod hole at an angle corresponding to the angle of the pushrod hole; and (d) a pushrod housing mounted around the pushrod and having an end mounted in the counter bore in the composite pushrod hole adapter plate.

10. An internal combustion engine having a crank case and a cylinder head adaptable to a variety of pushrod positions and angles, comprising:

(a) a cylinder head having a pushrod hole aperture formed therein, wherein the pushrod hole aperture is sufficiently large to allow a pushrod to pass therethrough at a plurality of pushrod positions and angles;

(b) a composite pushrod hole adapter plate mounted over the pushrod hole aperture on a side of the cylinder head facing the crank case, the composite pushrod hole adapter plate having at least one pushrod hole extending therethrough at an angle and having a counter bore formed coaxial with the pushrod hole at an angle corresponding to the angle of the pushrod hole;

(c) a pushrod extending through the pushrod hole at an angle corresponding to the angle of the pushrod hole; and (d) a pushrod housing mounted around the pushrod and having an end mounted in the counter bore in the composite pushrod hole adapter plate.

11. The internal combustion engine of claim 7 comprising additionally a tappet block having a second pushrod hole aperture formed therein, wherein the second pushrod hole aperture is sufficiently large to allow the pushrod to pass therethrough at a plurality of pushrod positions and angles, and a second composite pushrod hole adapter plate mounted over the second pushrod hole aperture, the second composite pushrod hole adapter plate having at least one pushrod hole extending therethrough at an angle and having a counter bore formed coaxial with the pushrod hole at an angle corresponding to the angle of the pushrod hole, and wherein the pushrod extends through the pushrod hole in the second composite pushrod hole adapter plate at an angle corresponding to the angle of the pushrod hole, and the pushrod housing has a second end mounted in the counter bore in the second composite pushrod hole adapter plate.

12. The internal combustion engine of claim 10 wherein the composite pushrod hole adapter plate is removably mounted to the cylinder head over the pushrod hole aperture.

13. The internal combustion engine of claim 12 wherein the composite pushrod hole adapter plate has at least one fastener hole extending therethrough for receiving a fastener for removably mounting the composite pushrod hole adapter plate to the cylinder head over the pushrod hole aperture.

14. The internal combustion engine of claim 10 wherein the composite pushrod hole adapter plate includes at least two pushrod holes extending entirely through the adapter plate and wherein a first pushrod hole extends through the adapter plate at a first angle and a second pushrod hole extends through the adapter plate at a second angle which is different from the first angle.

15. The internal combustion engine of claim 14 wherein the composite pushrod hole adapter plate includes a counter bore formed around each of the pushrod holes wherein each counter bore is formed coaxial with and at an angle corresponding to the angle of its corresponding pushrod hole.

16. The internal combustion engine of claim 15 comprising a pushrod extending through each of the pushrod holes at angles generally corresponding to the angles of the pushrod holes, and a pushrod housing mounted around each of the pushrods, wherein each pushrod housing includes an end mounted in one of the counter bores in the composite pushrod hole adapter plate.

17. An adaptable engine component kit, comprising:

(a) an engine component having a pushrod hole aperture formed therein, wherein the pushrod hole aperture is sufficiently large to allow a pushrod to pass therethrough at a plurality of pushrod positions and angles;

(b) a plurality of different composite pushrod hole adapter plates, each of which is adapted to be mounted over the pushrod hole aperture and includes at least one pushrod hole extending therethrough at an angle and a counter bore formed coaxial with the pushrod hole at an angle corresponding to the angle of the pushrod hole, and wherein at least one of the plurality of pushrod hole adapter plates has a pushrod hole and corresponding counter bore formed therein at an angle which is different from the angle at which a pushrod hole and corresponding counter bore is formed in another of the plurality of pushrod hole adapter plates.

18. The adaptable engine component kit of claim 17 wherein the engine component includes a pushrod hole adapter plate pocket formed therein around the pushrod hole aperture and shaped to receive any one of the plurality of composite pushrod hole adapter plates.

19. The adaptable engine component kit of claim 17 wherein the engine component includes a groove formed around the pushrod hole aperture and shaped to receive an O-ring for sealing the engine component and one of the composite pushrod hole adapter plates mounted thereon.

20. The adaptable engine component kit of claim 17 wherein the engine component is a cylinder head having the pushrod hole aperture formed therein.

21. The adaptable engine component kit of claim 17 wherein the engine component is a tappet block having the pushrod hole aperture formed therein.

22. The adaptable engine component kit of claim 17 comprising additionally fastener means for removably mounting at least a one of the plurality of pushrod hole adapter plates over the pushrod hole aperture.

23. The adaptable engine component kit of claim 17 wherein each of the plurality of composite pushrod hole adapter plates has at least one fastener hole extending therethrough for receiving a fastener for removably mounting the composite pushrod hole adapter plate to the engine component over the pushrod hole aperture.

24. The adaptable engine component kit of claim 17 wherein each of the plurality of composite pushrod hole adapter plates includes at least two pushrod holes extending entirely through the adapter plate and wherein a first pushrod hole extends through the adapter plate at a first angle and a second pushrod hole extends through the adapter plate at a second angle.

25. The adaptable engine component kit of claim 24 wherein each of the plurality of composite pushrod hole adapter plates includes a counter bore formed around each of the pushrod holes wherein each counter bore is formed coaxial with and at an angle corresponding to the angle of its corresponding pushrod hole.

26. A method for assembling an internal combustion engine having a cylinder block, comprising the steps of:

(a) attaching a cylinder head having a pushrod hole aperture formed therein to the cylinder block, the pushrod hole aperture being sufficiently large to allow a pushrod to pass therethrough at a plurality of pushrod positions and angles;

(b) selecting a preferred composite pushrod hole adapter plate from a plurality of different composite pushrod hole adapter plates, each of which is adapted to be mounted over the pushrod hole aperture and includes at least one pushrod hole extending therethrough at an angle and a counter bore formed coaxial with the pushrod hole at an angle corresponding to the angle of the pushrod hole, and wherein at least one of the plurality of pushrod hole adapter plates has a pushrod hole and corresponding counter bore formed therein at an angle which is different from the angle at which a pushrod hole and corresponding counter bore is formed in another of the plurality of pushrod hole adapter plates;

(c) attaching the preferred composite pushrod hole adapter plate to the cylinder head over the pushrod hole aperture;

(d) extending a pushrod through the pushrod hole in the preferred composite pushrod hole adapter plate at an angle corresponding to the angle of the pushrod hole; and (e) mounting a pushrod housing around the pushrod by mounting an end of the pushrod housing in the counter bore in the preferred composite pushrod hole adapter plate.

27. The method of claim 26 wherein the steps of selecting a preferred composite pushrod hole adapter plate and attaching the preferred composite pushrod hole adapter plate to the cylinder head are performed prior to the step of attaching the cylinder head to the cylinder block.

28. The method of claim 26 wherein the step of attaching the preferred composite pushrod hole adapter plate to the cylinder head includes the step of placing the preferred composite pushrod hole adapter plate in a composite pushrod hole adapter plate pocket formed in the cylinder head around the pushrod hole aperture.

29. The method of claim 26 wherein the step of attaching the preferred composite pushrod hole adapter plate to the cylinder head includes the step of placing an O-ring in a groove formed in the cylinder head around the pushrod hole aperture.

* * * * *